US010188585B1

(12) United States Patent
Busiashvili

(10) Patent No.: US 10,188,585 B1
(45) Date of Patent: Jan. 29, 2019

(54) DEVICE FOR THE SUBLINGUAL ADMINISTRATION OF A MEDICATION FORMED FROM DISSOLVING A TABLET IN A LIQUID

(71) Applicant: Yuri Busiashvili, Pacific Palisades, CA (US)

(72) Inventor: Yuri Busiashvili, Pacific Palisades, CA (US)

( * ) Notice: Subject to any disclaimer, the term of this patent is extended or adjusted under 35 U.S.C. 154(b) by 0 days.

(21) Appl. No.: 16/040,890

(22) Filed: Jul. 20, 2018

(51) Int. Cl.
*A61J 7/00* (2006.01)
*A61J 1/20* (2006.01)

(52) U.S. Cl.
CPC ..... *A61J 7/0053* (2013.01); *A61J 1/201* (2015.05); *A61J 2205/50* (2013.01)

(58) Field of Classification Search
CPC ..... A61J 7/0053; A61J 1/201; A61J 1/202; A61J 1/2013; A61J 7/0015; A61J 7/0076; A61J 7/0092; B65D 83/04; B65D 83/06
See application file for complete search history.

(56) References Cited

U.S. PATENT DOCUMENTS 3,760,804 A * 9/1973 Higuchi ..... A61F 6/14 222/386
3,780,735 A * 12/1973 Crouter ..... A61D 7/00 604/218
3,908,654 A * 9/1975 Lhoest ..... A61J 1/2089 222/130
4,773,907 A * 9/1988 Urquhart ..... A61J 3/07 424/452
5,123,915 A 6/1992 Miller et al.
5,562,918 A * 10/1996 Stimpson ..... A61M 15/0028 128/200.24
5,647,349 A * 7/1997 Ohki ..... A61M 15/0028 128/203.12
5,674,530 A * 10/1997 Amidon ..... A61K 9/0004 424/453
6,948,522 B2 * 9/2005 Newbrough ..... A61J 1/2089 137/550
7,089,934 B2 8/2006 Stanforth et al.
8,361,497 B2 1/2013 Miller
8,464,712 B2 * 6/2013 Ganem ..... A61M 15/0028 128/203.12
9,114,090 B1 5/2015 Busiashvili
9,861,578 B1 1/2018 Busiashvili
2015/0005702 A1 * 1/2015 Soper ..... A61J 7/0046 604/78

* cited by examiner

*Primary Examiner* — Nathan R Price
*Assistant Examiner* — Melissa A Synder
(74) *Attorney, Agent, or Firm* — Ralph D Chabot

(57) ABSTRACT

A device for self-administration of liquid medication supplied by combining a tablet of medication located within the device with a dissolving liquid from a source which dissolves the tablet upon contact. The formed medication solution is then available for delivery to the sublingual area of a patient.

11 Claims, 3 Drawing Sheets

DEVICE FOR THE SUBLINGUAL ADMINISTRATION OF A MEDICATION FORMED FROM DISSOLVING A TABLET IN A LIQUID

BACKGROUND OF THE INVENTION

Oral delivery of medications is one of the most frequent techniques utilized for delivering medication to the body. One of the most popular delivery mechanisms is the capsule. The background of U.S. Pat. No. 8,361,497 issued to Miller provides a detailed description into the history and present techniques for capsule manufacture and is hereby incorporated by reference.

Capsules containing medication for oral intake are usually swallowed for delivery of the medication to the stomach, where the capsule dissolves within 20 to 30 minutes and the medication is absorbed into the bloodstream.

With respect to capsular delivery of liquid medication such as Nfedipine for treatment of of various cardio-vascular conditions, a 20 to 30 minute wait time until absorption into the blood stream is not acceptable for particularly acute coronary conditions.

One example of a method of sublingual delivery of liquid medication contained in a capsule is U.S. Pat. No. 9,114,090 issued to Busiashvili which describes a capsular design and medication discharge from the capsule onto the sublingual area of a patient.

Another example of a device for oral delivery of liquid medication from a capsule is U.S. Pat. No. 5,123,915 issued to Miller et al. where a gel cap is punctured and the liquid contained within gravitates to a pierced nipple for subsequent oral delivery.

Another known delivery mechanism is by spray application of the medication onto the sublingual area. However, with spray application there is no limit upon the maximal amount of liquid medication delivered. In other words, a patient can repeatedly spray doses thus potentially overmedicating the condition.

For situations in which the patient or user is dealing with an acute condition such as an acute coronary insufficiency, a heart attack, hypertensive crisis or arrhythmia and for which a medication, such as Nifedipine, Nitroglycerin or others are proscribed, the user is likely to take more medication than necessary or maximally allowed. The higher the dose of a given medication as a bolus, or provided instantly, the higher the risk of cardiovascular collapse, syncope or death. Accordingly, there is a need for a device or method to apply the medication, such as Nitroglycerin or Nifedipine, incrementally, and limit the total amount of medication, particularly in medical emergencies for most patients.

SUMMARY OF THE INVENTION

Described herein is a device and methodology used for providing a limited amount of a tabular dosage medication. Preferably, the device would be used for sublingual self-administration of medication in medical emergencies whereby a fraction of the medication can be applied to the sublingual area at a given time. The device allows for the positioning of a dissolvable tablet of medication and provides a needle as a conduit for delivery of a dissolving liquid to dissolve the tablet. The dissolving liquid is provided to the device from an external source such as a capsule or syringe. Preferably, the external source will contain no more than about 3 cubic centimeters (cc).

In one embodiment, the dissolving liquid is present within a capsule which is punctured by the tip of the needle and the dissolving liquid exits the needle to flow into an enclosure for contact with, and dissolving of the tablet, thus forming a medication solution for sublingual application.

One purpose of the invention is to limit the dosage of medication used in an urgent situation to the minimally effective amount by administering a single dose as a drip incrementally under the tongue to achieve the desired effect and avoid complications that can occur when a full dose is administered as a bolus (i.e. too much delivered too quickly).

As defined herein, the term "tablet" means a medication in tablet, pill or other form which is somewhat brittle and capable of being fractured and dissolved by a dissolving liquid. For example, a 400 mcg tablet of Nitroglycerin can be dissolved in a normal saline solution within one minute.

As defined herein, the term "hollow needle" means a hollow needle having a gauge size of between 7-gauge to 33-gauge. The term "needle" is also used interchangeably in the summary and description herein and refers to the same term.

A common example of medication envisioned to be used by this device is Nitroglycerin or any other medication that can be provided in tablet form and dissolved prior to sublingual application.

Because the purpose of my invention is sublingual application of medication, the liquid volume should be no greater than about 1.5 cc per sublingual application.

The device described herein has upper and lower portions. The lower portion includes a recess sized to receive a tablet of medication and an exit pathway which is preferably located beneath the tablet position. The upper portion includes a cylindrical cavity with the surrounding inner wall adapted for receiving a structure containing a predetermined amount of dissolving liquid. Preferred embodiments for the structure containing the dissolving liquid can include a capsule or a needleless syringe having a standard male threaded Luer lock. The surrounding inside wall of the cylindrical cavity would include the standard female threads for connection to the male threaded Luer lock.

For embodiments of the device receiving dissolving liquid from a capsule, the capsule is partially received within the cavity. Extending upward from the base wall of the cylindrical cavity is a hollow needle with a piercing tip facing into the cavity and the length of which is appropriately sized to puncture the capsular wall so that the liquid can enter the hollow needle. The dissolving liquid, upon sufficient force applied to the non-punctured end of the capsule, will flow through the needle and inlet and into a chamber which houses a tablet of medication as will be described below.

For embodiments of the device receiving dissolving liquid from a syringe, the syringe is partially received within the cavity of the upper portion. Extending upward from the base wall of the cylindrical cavity is a hollow needle with a piercing tip facing into the cavity and the length of which is appropriately sized to puncture a seal which may be present at the discharge tip of the syringe and extend into the syringe as the syringe is partially rotated relative to the upper portion to obtain a leak-free connection and permit the dissolving liquid to enter the hollow needle as the plunger of the syringe is depressed and flow into a chamber which houses a tablet of medication as will now be described.

The chamber is generally defined as the recess of the lower portion bounded by the bottom surface of the upper portion. Also, extending into the chamber from the adjoining bottom surface of the upper portion is at least one rigid post. The purpose of the post is to fracture the tablet as the upper portion and lower portion come together to form the chamber. The post(s) can be of any design so long as the design will function to fracture a tablet of medication.

Closure means is defined as either the threadable engagement or hinge attachment described herein whereby the one or more posts are at the maximum extent into the chamber. When the one or more post is in this maximum extent position, the tablet positioned within the chamber will be in a fractured state. Thus, the tablet will be in a fractured condition either by full threaded engagement of the upper portion to the lower portion; or, in an embodiment where the upper and lower portions are connected by a hinge, by full closure of the upper portion upon the lower portion. Fracturing of the tablet increases the surface area with which the dissolving liquid can react and thus, dissolves the tablet medication more quickly. Upon contact with the liquid, the tablet of medication dissolves forming a medication solution. In a preferred embodiment, the side of the chamber opposite the inlet includes an exit pathway having a distal discharge nozzle from which the medication solution can exit the device for application to the sublingual area.

Preferably, the volume of liquid contained within the source of the dissolving liquid is at least the sum of the volumes of the needle, pathway and twice the chamber volume. This is to ensure sufficient liquid is available to not only dissolve the tablet, but to also provide a sufficient volume of liquid to discharge the medication solution.

Medication contemplated for use by my device include Nitroglycerin tablets, calcium channel blockers such as Nifedipine; Verapamil, potency drugs, such as Viagra, Sidenafil Citrate; beta blockers such as Propranolol, Timolol, etc.; and anti-anxiety medications such as Valerian root.

Besides water, other dissolving liquids could include a normal saline-physiologic solution such as 0.9% sodium chloride, or a menthol solution that can potentially reduce the amount of Nitroglycerin or Nifedipine used by having an additive effect.

The intended purpose of my device is to first deliver a fraction of the available therapeutic amount sublingually which will alleviate the patient's acute condition in as short a time as thirty seconds and if the first droplets (i.e. volume fraction) exiting the device was insufficient to alleviate the medical condition in less than a minute, the remaining volume of medication solution can be used as a subsequent volume fraction(s) i.e. droplets, administered over an extended time span.

Because the medication is to be delivered sublingually, the volume applied for any single dosage is only a few droplets totalling no more than about 1.5 cc. Accordingly, the chamber may contain, once the tablet is dissolved, multiple dosages for sublingual application.

In another variant of my invention, the chamber volume is preferably limited to the volume of medication which can be maximally applied for a single sublingual dosage. Accordingly, the chamber volume should be no greater than 1.5 cc.

In a second variant of my invention, the device is equipped with a tablet of medication which occupies the chamber earlier described. The chamber volume may not be large enough for a sufficient volume of dissolving liquid to enter the chamber and completely dissolve the tablet. For such a medication and tablet size, the dissolving solution will dissolve a portion of the medication which can be used, all or in-part, for a first dosage delivery. As the dissolved solution exits the chamber, it is replaced with dissolving liquid which can then react with tablet fragments remaining in the chamber.

Multiple designs can achieve the intended purpose of my invention. The following are examples.

1) The device can be designed to insert a tablet of medication into the lower portion recess of the device and then fracture the tablet by subsequently threadably engaging the upper portion to the lower portion until the tablet is fractured by the post(s);

2) The device is pre-assembled with the tablet of medication so that the tablet can be fractured by the post(s) with only a minor threadable rotation of the upper portion to the lower portion such as a quarter or half a revolution. Preferably, indicia could be present on the exterior to alert the user when the tablet is fractured. Such indicia could be an arrow present on each portion and when the table is fractured, the arrows would be aligned with the tips facing one another.

3) Rather than threadable engagement of the upper and lower portions as described for 1) and 2), a hinge connects the upper and lower portions and when rotated into a closed position the post(s) will fracture the tablet.

Following fracture of the tablet, a source for dissolving liquid is partially inserted into the cylindrical cavity of the upper portion. Next, a sufficient force is applied to the exposed end of the dissolving liquid source to force the dissolving liquid into the chamber and into contact with the fractured tablet. After a volume of dissolving liquid is forced into the chamber, it is necessary to wait a period of time (such as one or two minutes) for the tablet to be sufficiently dissolved. The degree that the tablet dissolves will depend upon the volume of liquid within the chamber. After the waiting period, force is again applied to the capsule to drive the liquid medication out of the chamber, into the exit pathway and be discharged for sublingual application.

In embodiments where the dissolving liquid source is a capsule, force applied to the capsule can be accomplished by various methods. For example, in a first embodiment, the top portion of the capsule is exposed and force can be applied by the index finger and thumb to crush the capsule and force the medication from the capsule into the chamber. In a second embodiment, a removable cover is provided and threadably connected to the top portion of the device. When in position, the cover shrouds the cylindrical cavity and capsule positioned therein. As the cover is rotated into further contact with the top portion, the capsule is progressively crushed and the discharge of the liquid contents of the capsule can be more precisely controlled.

The user will sense the medication dropping onto the sublingual area. Alternatively, the user may place their lips about the nozzle and suck the nozzle like the end of a straw.

DESCRIPTION OF THE PREFERRED EMBODIMENT

The figures provided herein are not drawn to scale and are provided for representational and instructional purposes.

Figure 2:
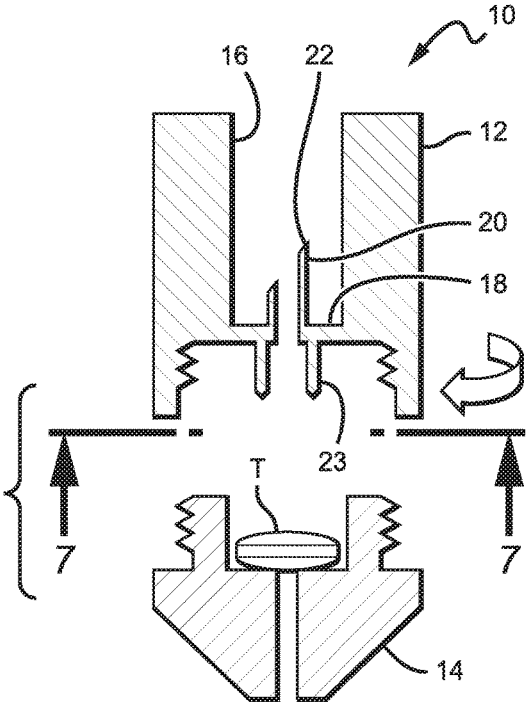
FIG. 2 is a view of one embodiment of the device where the upper portion is threadably connected to the lower portion described in FIG. 1.
Figure 7:
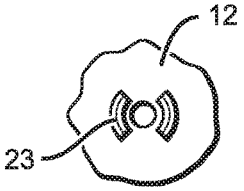
FIG. 7 is a view of FIG. 2 taken along line 7-7 illustrating the post.

FIG. 2 illustrates an exploded view of device 10. The exterior configuration is not limited to that disclosed but can be of any configuration suitable to be hand-held. Device 10 comprises an upper portion 12 and a lower portion 14. The top surface of upper portion 12 includes a cylindrical cavity 16 having a base 18. Extending away from base 18 is a hollow needle 20 with a piercing tip 22 which extends into cavity 16. The cavity is sized for receiving and aligning a capsule C so that one end of the capsule can be punctured by piercing tip 22. Capsule C contains a dissolving liquid L to dissolve tablet T as described below. The inserted end of capsule C can be punctured by applying an appropriate force F1 as illustrated in FIG. 4 preferably with a user's thumb and/or forefinger. The bottom surface of upper portion 12 includes a pair of posts 23 extending away in a perpendicular direction. FIG. 7 shows a view of posts 23 taken along line 7-7 of FIG. 2. In the figures presented, posts 23 have a tapered tip and have an arcuate profile. Each post can be of any configuration which is capable of fracturing a tablet T when positioned within chamber 40.

Figure 1:
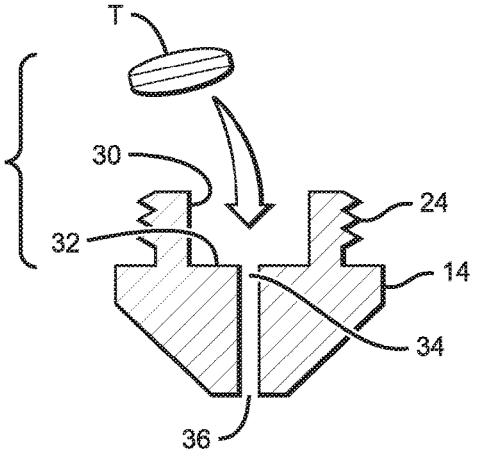
FIG. 1 is a cross sectional view of the lower portion of the device illustrating positioning of a tablet of medication into the recess.

As illustrated in FIG. 1, lower portion 14 includes a recess 30 sized to accept a tablet T of medication and male threads 24 for threadable engagement to upper portion 12. Recess 30 includes a base wall 32 having an exit pathway 34 leading to discharge 36. When positioned within recess 30, tablet T covers exit pathway 34.

Figure 3:
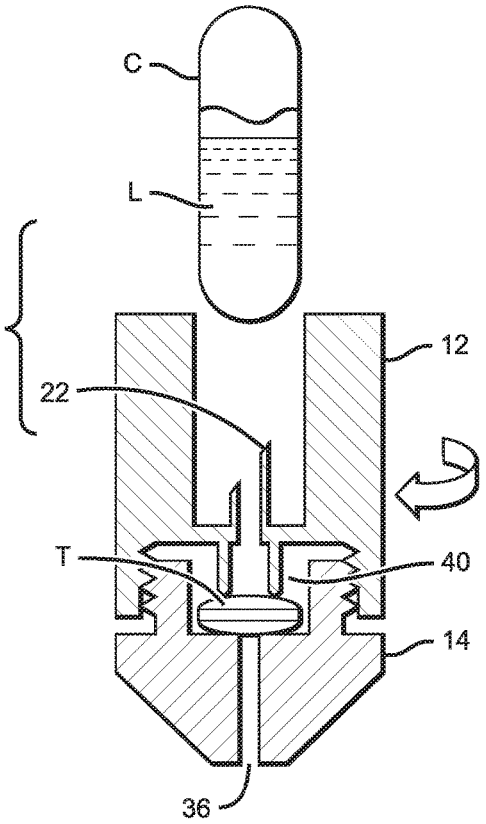
FIG. 3 illustrates the insertion of the capsule containing liquid solution into position to be punctured by the device's needle tip.
Figure 3A:
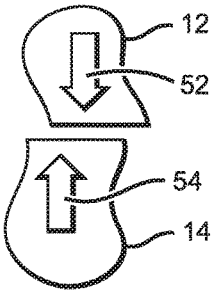
FIG. 3A illustrates non-aligned indicia arrows on the exterior surface of the upper and lower portions.

FIG. 3 illustrates upper portion 12 and lower portion 14 in threaded engagement in a first position in which recess 30 is now enclosed and thus forms chamber 40. In this first position, posts 23 extend a sufficient distance into chamber 40 to nearly or slightly contact tablet T. The first position is also represented by the non-alignment of indicia arrows 52 and 54 as shown in FIG. 3A.

Figure 4A:
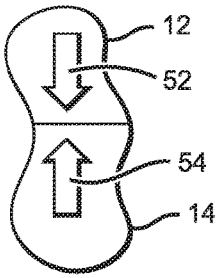
FIG. 4A illustrates aligned indicia arrows on the exterior surface of the upper and lower portions.
Figure 4:
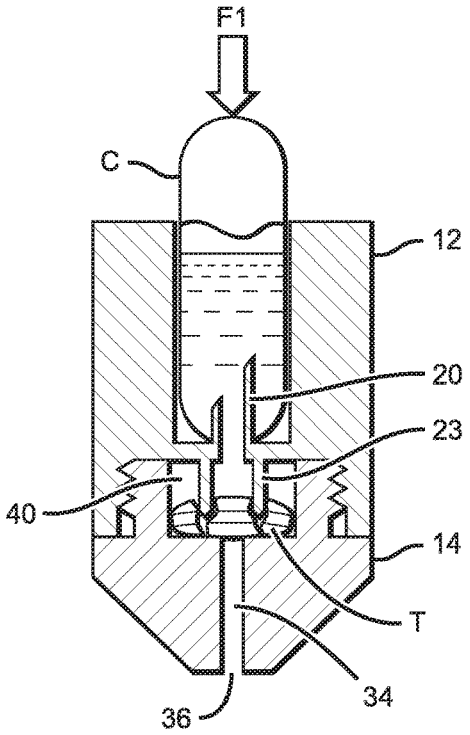
FIG. 4 illustrates complete threaded engagement of the upper portion to the lower portion where posts 23 extend sufficiently to fracture the tablet and the method of adding liquid solution to the chamber by applying a force to the exposed end of the punctured capsule.

FIG. 4 illustrates the complete threaded engagement of upper portion 12 to lower portion 14 which defines a second position which is represented by the alignment of indicia arrows 52 and 54 as shown in FIG. 4A. In this second position, posts 23 are fully extended into chamber 40. The full extension of posts 23 into chamber 40 will cause tablet T to fracture. Fracture of tablet T increases the available surface area to be reacted upon by dissolving liquid L. Thereafter, a sufficient force F1 is applied to capsule C in order for needle tip 22 to puncture the capsular wall.

Figure 5:
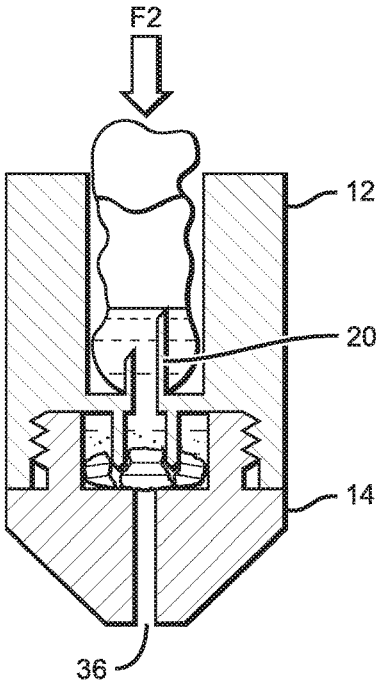
FIG. 5 illustrates the liquid solution in contact with a partially dissolved tablet of medication in the chamber.
Figure 6:
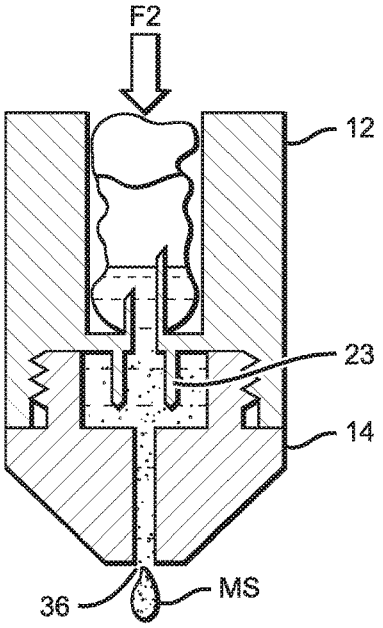
FIG. 6 illustrates the medication solution formed from the dissolved tablet and continued force upon the capsule causing the medication solution to be discharged from the device.

As best illustrated in FIG. 5, upon sufficient force F2 applied to the non-punctured end of the capsule C, the capsule will be progressively crushed and liquid L will be forced through needle 20 and into chamber 40 which houses tablet T. The volume of chamber 40 is no more than approximately 1.5 cc.

Exit pathway 34 leads to discharge 36 from which the medication solution can exit the device for sublingual administration. As tablet T is dissolved by liquid L, a medication solution is formed MS. Once the liquid L present in chamber 40 reacts to at least partially dissolve tablet T, medication solution MS can flow through exit pathway 34 to discharge 36. Preferably, the diameter of exit pathway 34 should be small enough for droplets to form at discharge 36. Most preferably, the diameter should approximate or be slightly larger than the diameter of needle 20. Because of the narrow diameters of both needle 20 and pathway 34, force must be applied to cause the medication solution to exit the device for application to the sublingual area. This force is either applied to the top of the capsule C or by suction where the user places his lips about discharge 36 and applies suction.

In practice, when force is applied to have the MS exit the device, two or three droplets of MS will be discharged from device 10. Once the droplets have been applied, the user waits between 30 seconds and one minute to determine whether additional MS is necessary. During this waiting period, dissolving liquid L, which was used to force MS past discharge 36, now is within chamber 40 reacting to dissolve any remaining portion of tablet T. After the waiting time, this volume of liquid L in chamber 40 has dissolved any remaining portion of tablet T after the first sublingual application to create a medication solution MS for a second sublingual application, if necessary. Most preferably, the second sublingual application, if necessary, would be applied by placing the user's lips about the discharge and applying a suction force to withdraw the medication solution present within the chamber.

Figure 8:
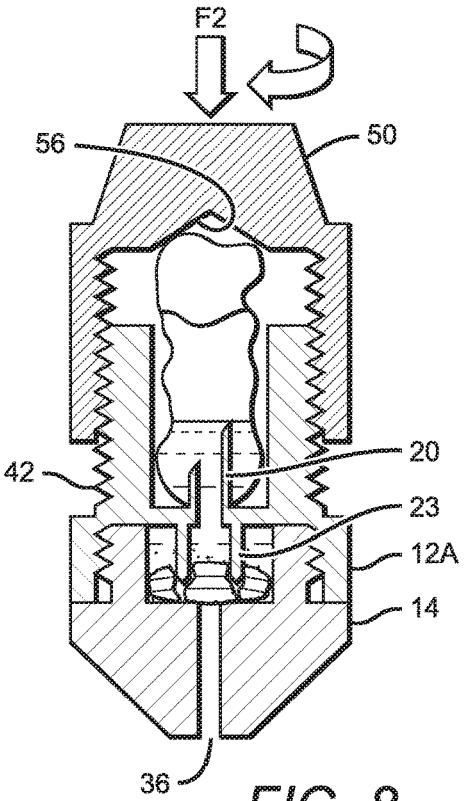
FIG. 8 is a first alternative embodiment in which a cover is threadably connected to the device for threadably applying force to the capsule to discharge liquid.

In a first alternative embodiment of the device as illustrated in FIG. 8, a cover 50 is threadably mounted to male threads 42 present on upper portion 12*a*. The interior surface 56 of cover 50 is preferably conically tapered. As cover 50 is rotated, capsule C is progressively crushed. Cover 50 can be rotated until substantially all of liquid L has been displaced from the capsule.

After the first fraction of the total volume dosage has been delivered to the sublingual area, the patient need only wait a matter of 30-60 seconds. If the cardiac event does not subside, cover 50 can be rotated relative to upper portion 12*a* to allow a second fraction of the total volume dosage to flow from discharge 36.

Figure 9:
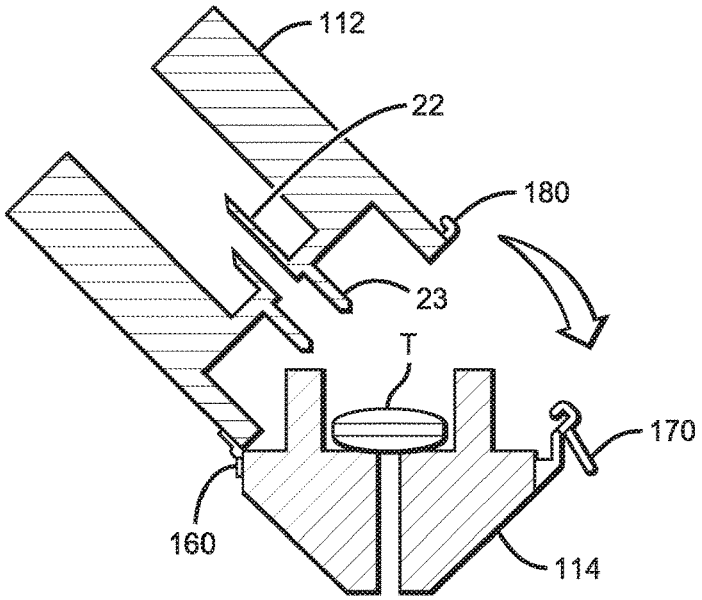
FIG. 9 is a second alternative embodiment in which the upper portion and lower portion of the device are attached by a hinge.
Figure 10:
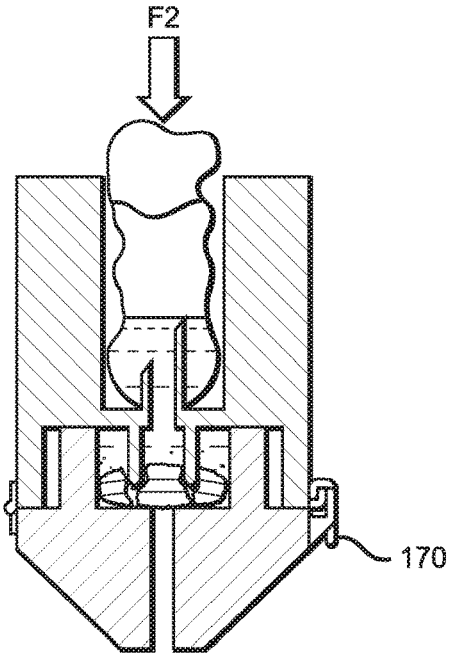
FIG. 10 illustrates the second alternative embodiment in the closed position.

In a second alternative embodiment of the device as illustrated in FIG. 9, rather than threadable engagement of upper and lower portions, upper portion 112 and lower portion 114 are attached by a hinge 160. To fracture tablet T, upper portion 112 is rotated to a final position as illustrated in FIG. 10. It should be noted that FIGS. 9 and 10 illustrate the method by which the tablet is fractured. Posts 23 could also be provided as part of an upper portion where they are orientated 90 degrees about needle 20 so posts 23 contact tablet T at the same time. A clasp 170 engages lip 180 to ensure proper closure for obtaining a liquid tight seal between both portions. A capsule C is then utilized in the same manner as discussed earlier for delivery of dissolving liquid to chamber 40.

Figure 11:
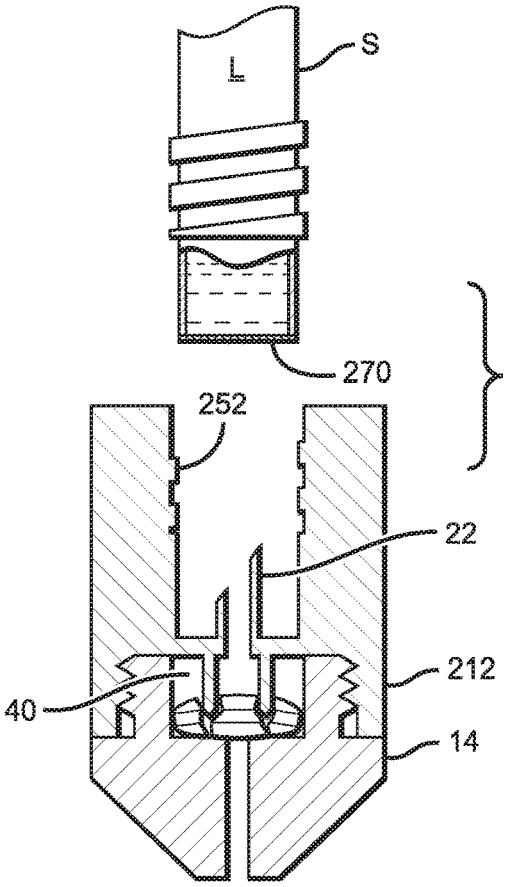
FIG. 11 is a third alternative embodiment illustrating the use of a syringe as a dissolving liquid source.

In a third alternative embodiment of the device as illustrated in FIG. 11, rather than using a capsule as the source of the dissolving liquid, a syringe S is provided. Syringe S incorporates male threads 250 to create a liquid tight seal by engagement with female threads 252 located on the interior wall of upper portion 212. Preferably, syringe S has a protective film 270 located at the tip. Syringe S is inserted into the cavity so needle tip 22 pierces protective film 270 for needle 20 to be a conduit for dissolving liquid L to pass into chamber 40. Force would be applied to the syringe plunger (not shown) for dispensing dissolving liquid L into chamber 40.

It should be understood that the cavity of upper portion 212 could also receive a capsule containing dissolving liquid rather than a syringe as illustrated.

I claim:

1. A device for the sublingual administration of a liquid medication formed from dissolving a tablet in a dissolving liquid comprising:

an upper portion connected to a lower portion;

the upper portion comprising:

a bottom surface having at least one post and opposite the bottom surface, a cylindrical cavity having a base wall;

a hollow needle having a piercing tip extending upward from the base wall; the cylindrical cavity sized to receive and align an external source containing a dissolving liquid, said hollow needle capable of piercing one end of the external source by the piercing tip;

the lower portion comprising:

a recess sized to accept a tablet of medication, the recess having a base wall having an exit pathway to a discharge located at the side of the lower portion opposite the recess for sublingual administration; and, when the upper portion and lower portion are connected, the interior space within the recess bordered by the base wall of the upper portion form a chamber having an interior volume and the at least one post sufficiently extends into the chamber to fracture a tablet of medication positioned within the chamber and the needle is a conduit for a dissolving liquid to enter the chamber.

2. The device of claim 1 where the interior volume of the chamber is no more than 1.5 cc.

3. The device of claim 1 where the upper portion is connected to the lower portion by a threaded connection.

4. The device of claim 1 where the upper portion is connected to the lower portion by a hinge.

5. The device of claim 1 further comprising said upper portion having a set of male threads for threadable engagement with a removable cover having a set of female threads; upon threadable engagement, the cover shrouds the cylindrical cavity.

6. The device of claim 5 where said cover includes an inside surface that is conically tapered.

7. A device for the sublingual administration of a liquid medication formed from dissolving a tablet in a liquid comprising:

an upper portion in threadable engagement to a lower portion;

the upper portion comprising:

a bottom surface having at least one post and opposite the bottom surface, a cylindrical cavity having a base wall;

a hollow needle having a piercing tip extending upward from the base wall; the cylindrical cavity sized to receive and align an external source containing a dissolving liquid, for piercing of one end of the external source by the piercing tip;

the lower portion comprising:

a recess where a chamber is defined by the recess bordered by the bottom surface of the upper portion, the chamber having an interior volume of no more than 1.5 cc and having a tablet of medication therein, the chamber having a base wall having an exit pathway to a discharge located at the side of the lower portion opposite the chamber for positioning upon the sublingual area; and, where said hollow needle defines a conduit through which a dissolving solution can enter the chamber and where the upper portion is in a first position relative to the lower portion in which the at least one post extends into the chamber; and where the upper portion can be rotated to a second position in which the at least one post fractures the tablet of medication.

8. The device of claim 7 further comprising indicia located on the upper portion and lower portion which will align when the upper portion and lower portion are in the second position.

9. The device of claim 7 further comprising said upper portion having a set of male threads for threadable engagement with a removable cover having a set of female threads; upon threadable engagement, the cover shrouds the cylindrical cavity.

10. The device of claim 9 where said cover includes an inside surface that is conically tapered.

11. A device for the sublingual administration of a liquid medication formed from dissolving a tablet in a dissolving liquid comprising:

an upper portion comprising:

a bottom surface having at least one post and opposite the bottom surface, a cylindrical cavity having a base wall;

a hollow needle having a piercing tip extending upward from the base wall; the cylindrical cavity sized to receive and align an external source containing a dissolving liquid, for piercing of one end of the external source by the piercing tip;

a lower portion comprising:

a recess sized to accept a tablet of medication, the recess having a base wall having an exit pathway to a discharge located at the side of the lower portion opposite the recess for sublingual administration; and, a closure means whereby the interior space within the recess bordered by the base wall of the upper portion form a chamber having an interior volume and the at least one post sufficiently extends into the chamber to fracture a tablet of medication positioned within the chamber and the needle is a conduit for a dissolving liquid to enter the chamber.

* * * * *